US006116959A

United States Patent [19]

Taylor

[11] Patent Number: 6,116,959

[45] Date of Patent: Sep. 12, 2000

[54] STACKED ELECTRICAL SOCKET ASSEMBLY

[75] Inventor: Robert William Taylor, Chipstead, United Kingdom

[73] Assignee: Cliff Electronic Components, Ltd., Redhill, United Kingdom

[21] Appl. No.: 08/856,496

[22] Filed: May 14, 1997

[30] Foreign Application Priority Data

Jun. 17, 1996 [GB] United Kingdom ..... 96126347

[51] Int. Cl.[7] ..... H01R 17/18

[52] U.S. Cl. ..... 439/668

[58] Field of Search ..... 439/668, 541.5

[56] References Cited

U.S. PATENT DOCUMENTS

| | | | |
|---|---|---|---|
| 4,165,147 | 8/1979 | Buck | 439/668 |
| 4,659,167 | 4/1987 | Masuda | 439/668 |
| 4,695,116 | 9/1987 | Bailey et al. | 439/668 |
| 4,867,708 | 9/1989 | Iizuka | 439/668 |
| 5,292,257 | 3/1994 | Milan | 439/214 |

FOREIGN PATENT DOCUMENTS

| | | |
|---|---|---|
| WO85/01167A1 | 3/1985 | WIPO . |
| WO92/07396 A1 | 4/1992 | WIPO . |

*Primary Examiner*—Steven L. Stephan
*Assistant Examiner*—T C Patel
*Attorney, Agent, or Firm*—McCormick, Paulding & Huber LLP

[57] ABSTRACT

A stackable electrical socket has an insulating body with a longitudinally extending bore for receiving an electrical plug member. Electrical contact elements extend partially into the bore for contact with the plug member when inserted, such contact elements having a leg part accommodated in one of a pair of first and second slots so as to extend from that one slot outwardly of the body for electrical connection. In this manner two similar insulating bodies of stackable electrical sockets can be stacked one on another so that the first and second slots of the overlying socket each overlie one of a first and second slot of the underlying connector and the leg part of the overlying connector which is presented for electrical connection is received through one of the first or second slots which is vacant of a leg part of the underlying socket for the leg part of the overlying socket to be presented for electrical connection from the underlying socket. The leg part of the overlying socket being insulated by the body material of the underlying socket from electrical contact with the leg part of the underlying socket.

17 Claims, 3 Drawing Sheets

STACKED ELECTRICAL SOCKET ASSEMBLY

The present invention relates to a stacked electrical assembly socket primarily, but not essentially, for use as a component on a printed circuit board and, more particularly, (but not exclusively) to a jack socket.

A jack socket comprises an elongated body of plastics material having a bore extending longitudinally therethrough and carrying one or more electrical elements each of which extends at least partially into the bore through aperture in the body so that when a jack plug is inserted into the bore it comes into contact with the electrical contacts therein. Such jack sockets are now commonly used with printed circuit board to facilitate connection of external electrical leads to the circuitry of such boards, a common example of being in audio equipment whereby the jack socket will be in communication with the exterior of the audio equipment to facilitate connection of an external lead thereto, such as for a speaker connection.

Modern technology, driven by consumer requirements, has lead to a continued reduction in the size of modern electric equipment, such as audio equipment, whereby the circuitry, and hence the circuit boards, for use in such equipment has gradually reduced through inventive developments in electronic circuitry design. However, despite reduction in the electronic components of such circuitry and the circuit board layout itself the sockets providing external connections with the circuit board must be maintained at a minimum size to facilitate safe receipt of standard size jack plug (or other plug connections) connected to an external lead (such as a speaker lead). Therefore, for electronic equipment having several external connection sockets the incorporation of the jack sockets on the circuit board can account for a significant portion of the circuit board size, restricting the reduction in the circuitry and hence the equipment. One attempt to overcome this problems has been to effectively stack two or more components, one on top of the other. However, this has proved very difficult for components for use on printed circuit boards since it is very difficult to achieve and maintain industry standard conducting paths to the printed circuit board. Furthermore where such stacked components have been utilised, they have employed stiff wires as the conducting elements from the upper components to the printed circuit board, with the result that for components which operate as switches (such as jack sockets) these wires are easily twisted under the impact of the jack plug entering the socket. In addition, where this problem has been addressed by bending such wires into forms which allow the wire to be trapped or fixed in a particular location in order to alleviate rotation, this results in undesirable occupation of additional space, defeating the original object of stacking the component.

An alternative method of stacking electrical components such as a jack socket, involves introducing rigid stacked jack sockets which are mounted directly in contact with the printed circuit board with wire connections welded between the printed circuit board and connections on the jack socket. However, this has a significant drawback of introducing an additional joint into the conducting path which can be an additional source of noise generation, particularly in the sensitive circuits such as those used in audio equipment.

It is therefore an object of the present invention to provide a stackable electrical socket which alleviates the aforementioned problems in a simple an inexpensive manner.

According to the present invention there is provided a stackable electrical socket comprising an insulating body with a longitudinally extending bore for receiving an electrical plug member, contact element means communicating with the bore for contact with the plug when inserted in the bore, the element means comprising a leg part, the body including first aperture means and second aperture means which are insulated from each other by the body material, one of the first or second aperture means accommodating the leg part to present that part for electrical connection, and wherein when two said insulating bodies of stackable electrical sockets are stacked one on another a leg part of the upper socket presented for electrical connection is received through one of the first or second aperture means which is vacant of a leg part of the underlying socket for the leg part of the overlying socket to be presented for electrical connection from the underlying socket and electrically insulated by the body material of the underlying socket from electrical contact with the element means of the underlying socket. This socket provides the substantial advantage of allowing two or more sockets to be stacked one on top of the other to reduce the amount of space required for such components in circuitry, such as a printed circuit board, while ensuring that electrical conducting paths of each socket are well insulating to alleviate the risk of shorting occurring between the sockets. It is also an advantage of this socket that such a socket may be used on its own or when stacked with others, thus enabling stacked or single sockets to be produced from one tool. Since the preferred material for the insulated body is plastics material, such as a nylon, the body is preferably molded using a single mold tool, from which individual or stacked connectors may be obtained.

The socket will usually be designed so that when two such insulating bodies of stackable electrical sockets are stacked one on another the first aperture means of the overlying socket may overlie the first aperture means of the underlying socket and the second aperture means of the overlying socket may overlie the second aperture means of the underlying socket. Alternatively, or in addition, the socket may be designed so that when two such insulating bodies of stackable electrical sockets are rotated through 180° relative to each other and stacked one on another the first aperture means of the overlying socket overlies the second aperture means of the underlying socket and the second aperture means of the overlying socket overlies the first aperture means of the underlying socket. In either case, the socket may have a bore central line offset from a centre line of the body or the bore central line may be coaxial with the central line of the body.

Preferably, the contact element means will have two leg parts diametrically opposed about the bore, with each leg part usually having associated therewith a first and second aperture means. Furthermore, it is preferable that the electrical contact between the two leg parts on the contact element may be broken by insertion of the plug member in the bore, such as in the case of a conventional jack socket to which the present invention is readily applicable.

Furthermore, it is usual for the socket to have two or more contact elements, as required for each particular application of the socket.

Usually, the aperture means will comprise a slot means, usually a slot, while in a preferred embodiment the first and second slot means may be angularly orientated at 90° relative to each other. The use of slot means is preferably to accommodate the leg part which is substantially flat. The use of flat leg parts, usually formed as flat section pressings, provide additional strength to the sockets when attached to the circuitry, since flat leg parts are more readily alleviated from twisting, especially when inserted through corresponding slots in a circuit board. The strength of the flat leg parts is further enhanced when two sockets are stacked together with the slot means at 90° relative to each other since this provides for flat leg parts presented from the underlying socket at 90° to each other. Since sockets of this type are subject to repetitive impacts during insertion of the plug into the bore, this additional strength can prolong the life expectancy of such sockets.

Usually, the body will have a first and second location means whereby when two such insulating bodies of stackable electrical sockets are stacked one on another the first location means of the underlying socket engages second location means of the overlying socket to orientate and locate the two stacked sockets in a predetermined orientation. Preferably, one of the first or second location means will comprise at least two projections and the other of the first and second location means will comprise at least two recesses.

Further according to the present invention there is provided a stacked electrical socket comprising two sockets as previously discussed in which the leg part of the overlying socket is of greater axial length than the leg part of the underlying socket so that the length of the leg part of the overlying socket presented for electrical connection from the underlying socket is of comparable length of the leg part of the underlying socket presented for electrical connection from the underlying socket.

Preferred embodiments of the present invention will now be described, by way of example only, with reference to the accompanying illustrative drawings in which.

Figure 1:
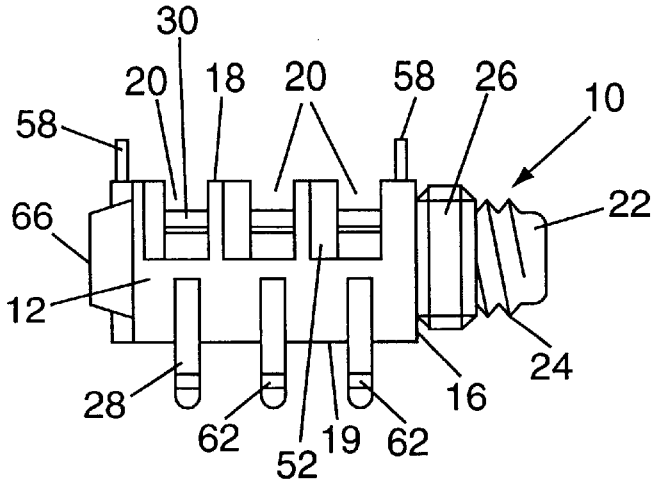
FIG. 1 is a side view of a Jack socket according to the present invention.
Figure 5A:
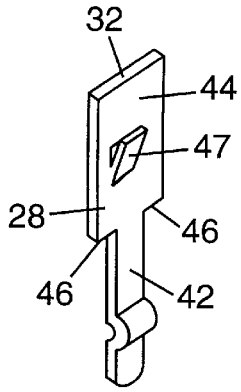
Figure 5B:
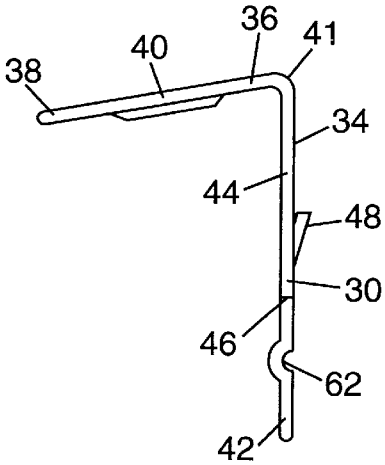
Figure 5C:
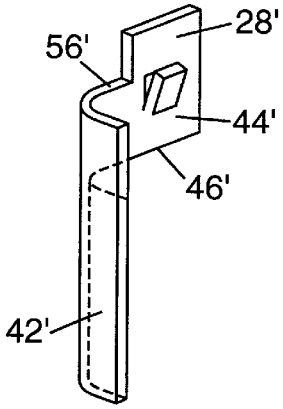
Figure 5D:
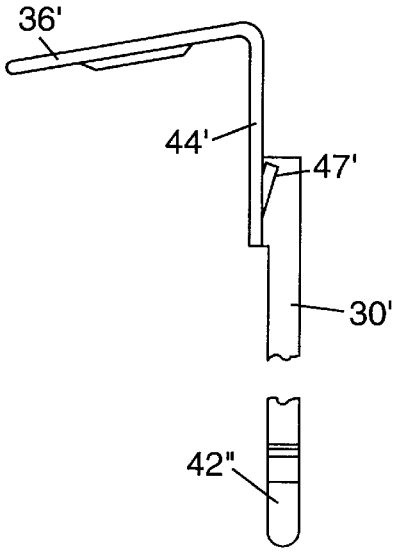

FIG. 4*a* is a rear end view of the socket shown in FIG. 1;

FIG. 5*a* is a perspective view of a first contact element of FIG. 1;

FIG. 5*b* is a side view of a second contact element of the socket of FIG. 1;

FIG. 5*c* is an alternative embodiment of the first contact element;

FIG. 5*d* is a side view similar to FIG. 5*b*, but shows an alternative embodiment of the second contact element.

Figure 5E:
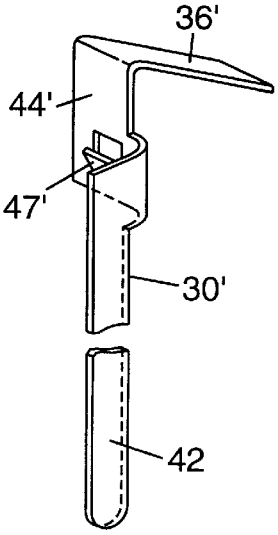

FIG. 5*e* is a somewhat enlarged perspective view of second contact element shown in FIG. 5*d*.

Figure 6A:
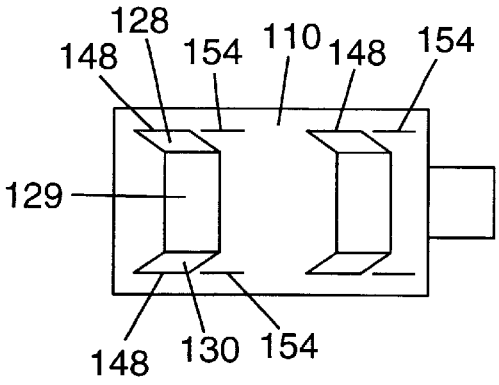
Figure 6B:
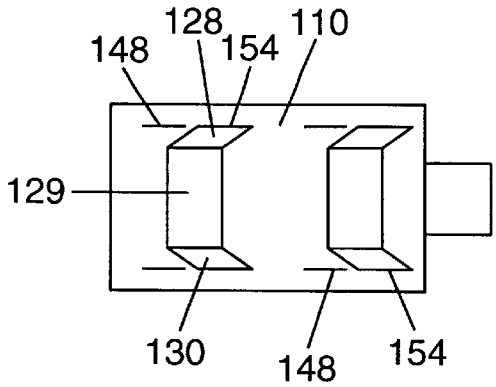
Figure 7A:
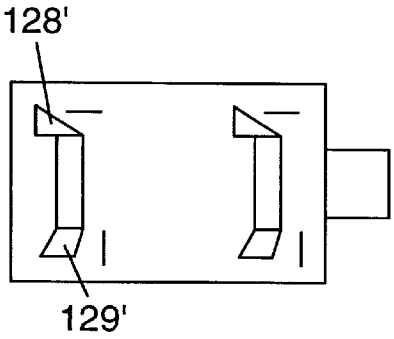
Figure 7B:
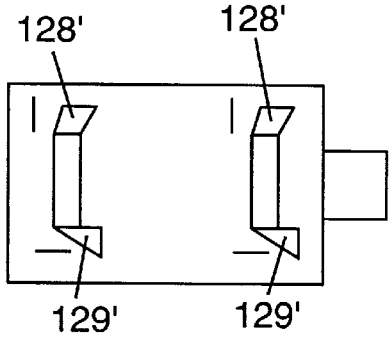
Figure 8:
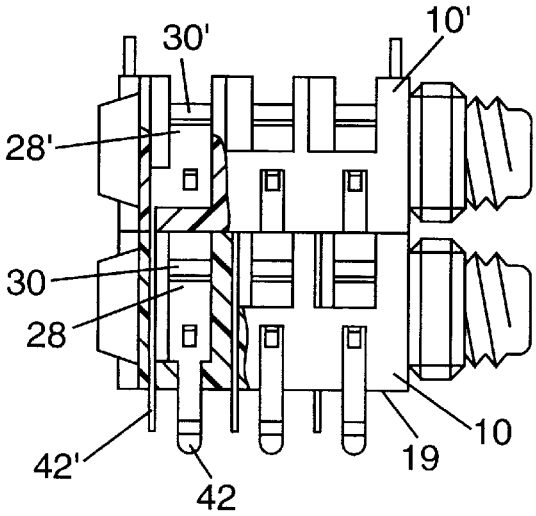

FIG. 6*a* is a schematic plan view from above of an alternative embodiment of a socket incorporating the present invention;

FIG. 6*b* shows the schematic socket of FIG. 6*a* with an alternative arrangement of contact elements;

FIG. 7*a* is a schematic plan view from above of an alternative embodiment of a socket of the present invention;

FIG. 7*b* shows the schematic socket of FIG. 7*a* having a alternative arrangement of contact elements; and FIG. 8 shows a side elevation of two stacked socket assemblies according to the present invention, portion of the socket bodies shown broken away.

Figure 9:
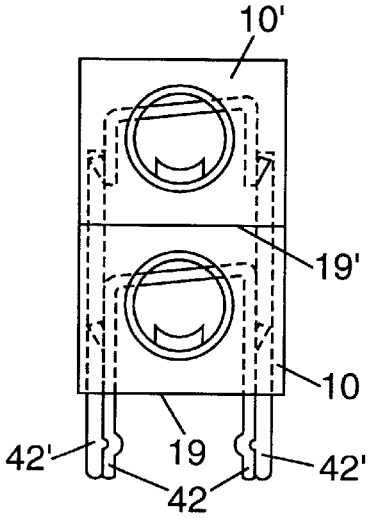

FIG. 9 is a front end view of the stacked socket assemblies shown in FIG. 8.

A socket assembly 10 comprises a substantially rectangular insulating body 12, usually of plastics material such as nylon, which is usually formed by conventional plastics molding. The body 12 comprises a substantially cylindrical bore 14 extending from a front end 16 thereof along at least a significant length of the body 12. A top surface 18 of the body 12 comprises an array of apertures 20 (three according to the preferred embodiment described) communicating between the bore 14 and the exterior of the body 12.

An annular projection 22 extends longitudinally from the front face of the body 12 extending the bore 14 outwardly from the body. This annular projection 22 has an external screw thread 24 with an associated nut 26 threaded thereon. In practice, the nut 26 is removed from the projection 22 and which projection 22 may then be passed through a preformed hole in a housing (not shown) wall and the nut then threaded onto the screw thread extending externally of the housing to secure the socket assembly to that housing. This also facilitates access to the socket bore.

Figure 4:
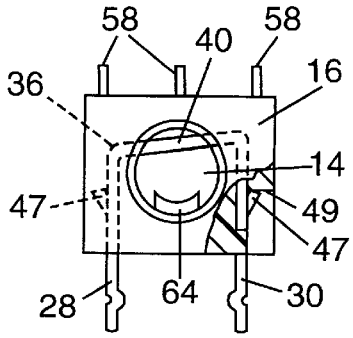
FIG. 4 is a front end view of the socket of FIG. 1 shown with a portion of the socket body broken away.

Each of the apertures 20 has an associated pair of electrical contact elements 28 and 30 (shown more clearly in FIGS. 4, 5*a* and 5*b*). The first contact element is substantially flat having an upper end face 32 whilst the second contact element 30 comprises a substantially flat side wall 34 with a substantially flat top wall 36 integral therewith. The top wall 36 having been bent about an elbow 41 slightly past the perpendicular to the side wall 34 to provide an acute angle between the side wall 34 and the top wall 36. This configuration allows a remote end 38 of the top wall 36 to lie on and provide electrical contact with the upper end face 32 of the associated contact element 28 when both contact elements 28 and 30 are inserted into the insulating body 12 (as shown in FIG. 4). Both element are securely restrained from displacement in the body 12. The design of the contact element 30 is such that the top wall 36 is spring biased to provide engagement with the contact element 28. Furthermore, the bent configuration of the contact element 30 provides that a central portion 40 of the top wall 36 projects partially into the bore 14 as shown in FIG. 4.

In this manner, when a jack plug (not shown) is inserted into the bore 14 it will engage the central portion 40 of the contact element 30 and will cause the top wall 36 to be displaced about the elbow 41 of the element 30 to increase the acute angle between the two walls of the element 30 against the natural spring biassing of this element design. This causes the remote end 38 of the contact element 30 to be moved out of an electrical engagement with the upper end face 32 the contact element 28. When lifted by the plug being inserted into the bore 14 the natural spring biassing of the contact element 30 ensures that adequate electrical contact is maintain between the jack plug and the contact element 30. This arrangement is conventional for jack sockets.

Figure 2:
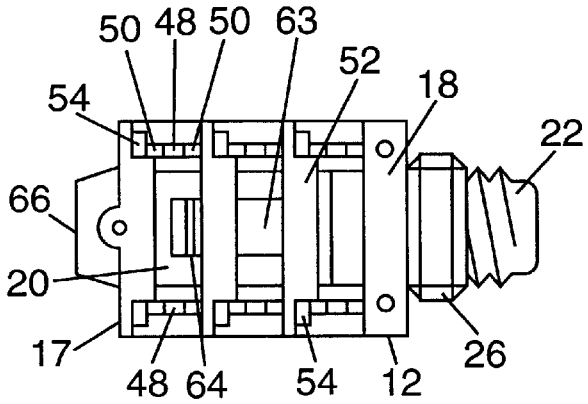
FIG. 2 is a plan view from above of the socket shown in FIG. 1 with the electrical elements removed.
Figure 3:
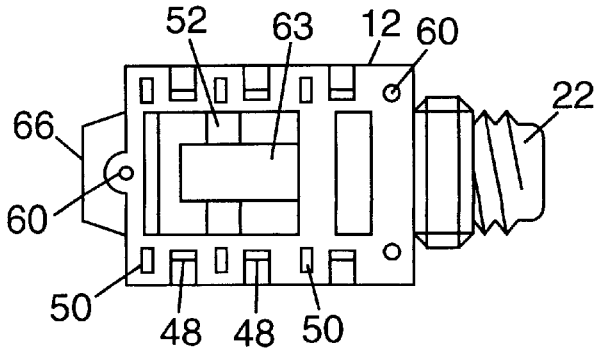
FIG. 3 is a plan view from below of the socket of FIG. 2.

The contact element 28 and the side wall 34 of contact element 30 are flat and extend coplanar to one another, each having a downwardly extending leg part 42 and an upper body portion 44, whereby the leg part 42 is narrower than the upper body portion 44 to present two downwardly directed shoulders 46 one either side of the leg 42. In addition, each of the upper body portions 44 comprise a resiliently deflectable projection 47, which is usually formed by punching through a central portion of the upper body portion 44 to form a tab structure. Each of the pairs of contact elements 28 and 30 are inserted in the body 12 for each pair to be associated with an aperture 20. As seen in FIGS. 2 and 3 each aperture 20 has associated therewith two legs slots 48 disposed one either side of the bore 14. Each leg slot 48 provides an aperture extending from the top surface 18 to a bottom surface 19 of the body. In this way, a leg part 42 of each contact element 28 and 30 is passed through the slot 48 to project downwardly from the bottom surface 19 of the body 12. Furthermore, each slot 48 has disposed on either side thereof recessed portion 50 which extend part way through the body 12 from the upper surface to present upwardly directed shoulders (not shown) against which the downwardly directed shoulders 46 of each contact element 28, 30 abuts when the leg part 42 has passed through the leg slot 48, thereby restraining each contact element 28, 30 from further downward displacement through the body. In addition, each leg slot 48 has an inwardly directed projection 49 for snap engaging co-operation with the projection 47 on each contact element 28 and 32 respectively as shown in FIG. 4. In this way as each contact element is passed into the body the shoulders 46 restrain the contact elements from further displacement downwardly through he body whilst the snap engaging projections between the contact elements 28, 30 and the body 12 restrain the contact elements 28, 30 from relative displacement upwardly relative to the body 12. In this way the contact elements 28, 30 are securely restrained in the slots 48 of the body 12.

Upstanding walls 52 on the body 12 ensure electrical insulation between each of the aperture 20.

The insulating body 12 further comprises secondary leg slots 54 one each disposed adjacent to the first leg slot 48 and orientated at right angles thereto. Again the secondary leg slots provides an aperture communicating between the upper and lower surfaces of the body 12.

The secondary leg slots 54 are used in conjunction with alternative contact element designs to construct a second socket assembly such as shown in FIG. 8 and 9 wherein the legs of the alternative contact elements are again substantially flat but angularly orientated at right angles to the leg structures of the socket 10 previously discussed with reference to electrical contacts elements 28 and 30. Referring now to FIG. 5*c*, an alternative embodiment of the first contact element 28, indicated at 28' (similar figure numbers will be used to identify similar parts of the contact elements 28' to those used for contact element 28) comprises an upper body portion 44' identical to that of contact element 28 with the exception that the downwardly directed shoulder 46' is in this case continuous. In addition, a leg part 42' is offset from the upper body portion 44' and substantially at a right angle thereto. The leg part 42' is supported offset from the main body portion 44' by an extension portion 56' which has a bottom face extending coplanar with the shoulder 46'. In a similar manner a corresponding contact element 30' shown in FIG. 5*d* and 5*e* corresponding to the contact element 30 shown in FIG. 5*b* is also provided having the leg offset at right angles to the upper body portion 44 in a similar arrangement to the contact element 28' shown in FIG. 5*c*. When such a pair of contact elements 28', 30' are inserted into the body 12 the shoulders 46' on the upper body portions 44' of each of the to contact elements 28', 30' again abut the upwardly directed shoulders in their recess portions 50 of the body 12, but the leg parts 42" are offset to be received in the secondary leg slots 54. The body portions 44' again having projections 47' for snap engagement with projections (not shown) within the body 12 to restrain the contact element 28', 30' from movement within the body. Although this arrangement provides contact element leg parts 42' extending from the bottom surface of the body 12 at substantially right angles relative to the projecting leg parts 42 of the socket 10 as previously described, the top wall 36' and correspond to the similarly numbered parts in FIG. 5*a*) of the contact element 30' is orientated relative to the upper body portion 44' of contact element 30' is an identical manner to the relationship of top wall 36 to the body portion 44 of element 30. In the manner, a central portion (40') of the contact element 30' extends through the aperture 20 in a similar manner to that previously described with reference to contact elements 28 and 30.

In the particular embodiment herein described, the leg parts 42' of the elements 28' (30') are substantially longer than the leg parts 42 of the contact elements 28 and 30 respectively.

Thus, when two socket assemblies 10 and 10' (FIG. 8) are constructed with contact elements 28, 30 and 28', 30' respectively it will be appreciated that the legs extending from the bottom surface 19' of the socket assembly 10' are considerably longer than the legs 42 extending from the bottom surface 19 of the assembly 10. In addition, the substantially flat leg parts 42' of the assembly 10' are substantially at right angles to the leg parts 42 of the assembly 10. In this manner, the socket assembly 10' may be mounted or stacked on top of the assembly 10 so that the bottom surface 19' of the assembly 10' abuts the top surface 18 of the assembly 10. Therefore, the leg parts 42' of the upper socket 10' extend through the empty secondary leg slots 50 of the lower stacked socket 10, remaining separated and insulated from the leg parts 42 and contact elements 28, 30 of the lower connector 10. Thus, when the two connectors 10 and 10' are stacked in this manner the bottom surface 19 of the lower socket 10 has projecting therefrom leg parts 42 and 42' from both socket assemblies 10 and 10'. Preferably the leg parts 42' are of such a length that they extend from the lower socket assembly 10 a distance equal to that of the leg parts 42 of the lower socket 10. The body 12 of the assembly 10 has three pin like projections 58 with corresponding recesses 60 in the bottom surface 19 underlying the pin like projections 58, so that when two similar bodies 10, 10' are stacked as previously described, the projections 58 of the lower socket assembly 10 are received within the corresponding recesses 60' in the upper stacked socket assembly 10' to both help locate the stacked socket assemblies 10, 10' and to hold these stacked socket assemblies 10, 10' in the required orientation relative to each other.

It will also be appreciated that the socket assembly 10 may be alternatively stacked on top of the socket assembly 10', simply requiring that the leg parts 42 of socket 10 be lengthened to a degree sufficient to pass through the slots 48 in socket 10'.

As previously discussed, socket assemblies 10 as described above are often for use on printed circuit boards whereby the leg parts 42, 42' of the respective contact elements are intended to pass through apertures in the printed circuit board, to be soldered to conducting tracks on such a circuit board.

Therefore, the leg parts 42 may be provided with recessed portions 62 which may snap engage with the printed circuit board to help support the socket assembly thereon and to provide additional strength and contact between the socket and board before and after soldering the contact elements to the printed circuit board.

In addition, the socket assembly 10 further incorporates a resiliently deflectable longitudinally extending lower bar 63 formed integral with the body 12. This bar has a curved inner surface defining a lower portion of the bore 14. This bar 63 further having an upstanding projection 64 (FIG. 4) which extends into the bore 14 towards a rear end 17 thereof, so that when a jack plug (not shown) is inserted into the bore 14 it will engage the projection 64, pushing said projection outwardly of the bore 14, thus deflecting the bar 63 downwardly with respect to the body 12. Such jack plugs usually comprise a circumferentially extending recess along part of their length and 30 when this recess passes over the projection 64 the resilient biassing of the bar 63 forces the projection 64 upwards into the recess in the jack plug to engage this circumferentially extending recess to help restrain the jack plug in the socket assembly 10.

The socket assembly 10 of the present invention further incorporates an enclosed end portion 66, having a solid rear wall, so that the jack plug may not protrude externally of the socket assembly 10. In this way, the jack plug is restrained from accidently contacting other elements of the printed circuit board. However, it will be appreciated that there may be circumstances where it is desirable to have additional contact with the jack plug and as such the end portion 66 may be removed to allow the jack socket to protrude externally from the back of the socket assembly.

It will be appreciated that the embodiments described with regard to FIGS. 1 to 5 are merely one such practical embodiment of the invention and that many other socket assembly design are possible which incorporate that present inventive concept. It may see from FIG. 1 that the preferred embodiment has utilized the use of three pairs of electrical contact elements,although it will be appreciated that any combination of one or more such pairs of electrical contact elements may be used in the present invention. In addition, the preferred embodiment relate to a conventional jack socket whereby insertion of a jack plug into such socket will break the electrical connection between each pair of connectors 28, 30'. However, the present invention is equally applicable to a socket whereby the pairs of electrical are secured together to form a single electric contact if this is so desired. In addition the present invention is equally applicable to sockets of the type whereby the bore 14 is offset from a centre line of the body, (so that the bore 14 is no longer coaxial with the central axis of the body as described for the preferred embodiment).

Furthermore, it will be appreciated that the use of substantially flat section connector leg parts helps alleviate the socket assembly from twisting during the rugged use of such a socket as a jack socket and that the use of flat leg parts in a stacked socket arrangement, as herein described where the leg parts 42, 42' are set right angles to each other will substantially increase the strength of the socket. However, it will be appreciated that the leg parts 42, 42' may be any shape, including cylindrical (as in conventional wire) whereby the associated slots are of a corresponding shape to support such legs.

It is also envisaged that the present application may be adapted for other arrangements of leg slots in the body, whereby the secondary leg slots (50) may extend parallel to the first leg slot 48 either in a longitudinal direction in respect to the bore 14 or transversally with respect to the bore 14. It is further conceivable that the leg slots may be orientated at any angle with respect to the bore 14, the adjustment to the electrical contact elements being very straight forward to effect the use of such angled slots.

The present invention can also be utilised to allow two identical socket assemblies to be stacked one on top of the other after the upper of the stacked socket assemblies has been rotated through 180° relative to the lower stacked socket assembly. For example, FIG. 6*a* shows a schematic layout of a socket assembly from above having an electrical contact 129 with first 128 and second 130 electrical contact elements. Each of the contact element 128 and 130 have leg parts (not shown) extending through a first leg slot 148 of an associated pair of leg slots 148 and 154. It will be appreciated when two similar sockets assemblies 110 are rotated 180° relative to one another and then stacked one on top of the other, that a leg part of contact element 128 will pass through a leg socket 148 of the upper socket assembly whilst passing through a leg slot 154 of the underlying socket assembly. FIG. 6*b* again shows a schematic view of a socket assembly 110 as shown in FIG. 6*a* with the exception that the orientation of the electrical contact element 128 and 130 have been reversed to extend through the associated leg slots 154. To this end, it should be appreciated that FIG. 6*a* and 6*b* show an alternative embodiment to the present invention whereby the socket assembly of 6*a* could be stacked on top of the socket assembly of FIG. 6*b* and vice versa without rotation of either socket. The invention relies on the fact that the leg parts of the upper stacked connector overlie a leg slot in the lower stacked socket assembly that is vacant of a leg part of the lower socket.

FIGS. 7*a* and 7*b* show schematically a further embodiment of the present invention, illustrating how a single electrical contact 129' may be adapted so that its first and second contact elements 128' and 129' are disposed at right angles to one another. Again it is clearly seen that the sockets shown in FIGS. 7*a* and 7*b* may each be stacked on a similar socket assembly when both sets of assemblies have been rotated through 180° relative to one another, or alternatively, socket assemblies according to FIG. 7*a* and 7*b* may be stacked one on top of another when maintained in the same orientation. There are numerous other possible arrangements to effect socket assemblies capable of being stacked and according to the present invention.

It is further conceivable that improvements to the layout design could be effected further to enable three or more similar like sockets to be stacked on top of another whereby each electrical contact element will need to have three or more associated leg slots. A leg slot will be required for each socket to be stacked. For example, with a three stacked socket arrangement three co-planar slots could be utilised, the only requirement being that each socket has a contact element passing through a different slot to the other in the stack.

I claim:

1. A stacked electrical socket assembly comprising; electrical sockets stacked one on another and including an upper socket and an underlying socket each having an insulating body formed of body material with a longitudinally extending bore for receiving an electrical plug member, said insulating body including first and second aperture means separated from each other by said body material, and contact element means communicating with said bore for contact with the plug when the plug is inserted in said bore, said contact element means comprising axially elongated downwardly extending first and second leg parts formed as flat section metal pressings, said first aperture means of said underlying socket accommodating said first leg part, said second aperture means of said upper socket accommodating said second leg part, said second leg part of said upper socket received through a vacant second aperture means of said underlying socket, said first and second leg parts being presented for electrical connection from the underlying socket and being angularly offset about the axes thereof relative to each other.

2. A stacked electrical socket assembly according to claim 1 wherein the sockets are stacked in the same orientation and the first aperture means of the upper socket overlies the first aperture means of the underlying socket and the second aperture means of the upper socket overlies the second aperture means of the underlying socket.

3. A stacked electrical socket assembly according to claim 1 in which the contact element means has two leg parts diametrically opposed about said bore.

4. A stacked electrical socket assembly according to claim 3 in which each leg part has associated therewith a first and second aperture means.

5. A stacked electrical socket assembly according to claim 3 in which electrical contact between the two leg parts on the contact element means is broken by insertion of the plug member in the bore.

6. A stacked electrical socket assembly according to claim 1 which the socket has two or more contact elements.

7. A stacked electrical socket assembly according to claim 1 which the body material comprises a molded plastics material.

8. A stacked electrical socket assembly according to claim 1, which the aperture means comprises a slot means.

9. A stacked electrical socket assembly according to claim 8, in which the first slot means and second slot means are orientated at 90° relative to each other.

10. A stacked electrical socket assembly according to claim 1 in which the body has first and second location means whereby the first location means of the underlying socket engages second location means of the upper socket to orientate and locate the stacked sockets in a predetermined orientation.

11. A stacked electrical socket assembly according to claim 10 in which one of the first or second location means comprises at least two projections and the other of the first and second location means comprises at least two recesses.

12. A stacked electrical socket assembly according to claim 1 in which each leg part has a first restraining means and said first and second aperature means has a second restraining means for cooperation with said first restraining when said leg parts extend through said first or second aperature means to restrain said leg part parts from displacement from said first or second aperature means.

13. A stacked electrical socket assembly according to claim 1 wherein each said socket is substantially in the form of a jack socket.

14. A stacked electrical socket assembly according to claim 1 in which the leg part of the upper socket is of greater length than the leg part of the underlying socket so that the length of the leg part of the upper socket presented for electrical connection from the underlying socket is of comparable length to the leg part of the underlying socket presented for electrical connection from the underlying socket.

15. A stacked electrical socket assembly as set forth in claim 1 wherein said aperture means comprise first and second slots angularly offset relative to each other formed in said insulating body.

16. A stacked electrical socket assembly as set forth in claim 15 wherein portions of said first and second leg parts presented for connection from the underlying socket are of substantially equal length.

17. A stacked electrical socket assembly as set forth in claim 16 wherein said first and second leg parts are offset 90° about the axes thereof relative to each other.

* * * * *

UNITED STATES PATENT AND TRADEMARK OFFICE

CERTIFICATE OF CORRECTION

PATENT NO. : 6,116,959
DATED : September 12, 2000
INVENTOR(S) : Robert William Taylor It is certified that error appears in the above-identified patent and that said Letters Patent is hereby corrected as shown below:

Column 7, line 1, after "and" please delete "30".

Signed and Sealed this

First Day of May, 2001

*Attest:*

Nicholas P. Godici

NICHOLAS P. GODICI

*Attesting Officer*

*Acting Director of the United States Patent and Trademark Office*